US008979419B2

(12) United States Patent
Heald

(10) Patent No.: US 8,979,419 B2
(45) Date of Patent: Mar. 17, 2015

(54) SECURITY BARRIER

(75) Inventor: Jonathan Roderic Heald, Hornsea (GB)

(73) Assignee: Heald Technologies Ltd., Hornsea (GB)

( * ) Notice: Subject to any disclaimer, the term of this patent is extended or adjusted under 35 U.S.C. 154(b) by 0 days.

(21) Appl. No.: 13/641,831

(22) PCT Filed: Apr. 14, 2011

(86) PCT No.: PCT/GB2011/000575

§ 371 (c)(1),
(2), (4) Date: Feb. 6, 2013

(87) PCT Pub. No.: WO2011/131924

PCT Pub. Date: Oct. 27, 2011

(65) Prior Publication Data

US 2013/0209167 A1 Aug. 15, 2013

(30) Foreign Application Priority Data

Apr. 19, 2010 (GB) ..... 1006439.2

(51) Int. Cl.
*E01F 13/04* (2006.01)
*E01F 15/12* (2006.01)
*E01F 13/12* (2006.01)

(52) U.S. Cl.
CPC ..... *E01F 15/12* (2013.01); *E01F 13/123* (2013.01); *E01F 13/04* (2013.01)
USPC ..... 404/6

(58) Field of Classification Search
CPC ..... E01F 13/123; E01F 13/12; E01F 13/044; E01F 15/00; E01F 15/003
See application file for complete search history.

(56) References Cited

U.S. PATENT DOCUMENTS 7,114,873 B2 * 10/2006 Rastegar et al. ..... 404/6

FOREIGN PATENT DOCUMENTS

| | | |
|---|---|---|
| EP | 1 277 885 | 1/2003 |
| GB | 2 296 277 | 6/1996 |
| GB | 2 367 085 | 3/2002 |
| WO | WO 2009/123485 | 10/2009 |

OTHER PUBLICATIONS

International Search Report dated Jul. 20, 2011 issued in corresponding International Application No. PCT/GB2011/000575.

* cited by examiner

*Primary Examiner* — Thomas B Will
*Assistant Examiner* — Katherine Chu
(74) *Attorney, Agent, or Firm* — Lempia Summerfield Katz LLC

(57) ABSTRACT

The invention relates to a security barrier, and a method for operation thereof. The security barrier (10) comprising a support (12) and a barrier member (30) movable relative to the support between a stowed position and a deployed position. The support (12) having an upper part (22) for positioning substantially at ground level (106). The barrier member (30) being rotatably mounted relative to the support (12) such that an axis of rotation (76) of the barrier member (30) is above the upper part (22).

23 Claims, 7 Drawing Sheets

SECURITY BARRIER

RELATED APPLICATION DATA

This U.S. national phase application is based on International Application No. PCT/GB2011/000575 filed on Apr. 14, 2011, which claimed priority to Great Britain Patent Application No. 1006439.2 filed on Apr. 19, 2010. Priority benefit of these earlier filed applications is hereby claimed, and the full disclosures of these earlier filed applications are hereby incorporated by reference herein.

TECHNICAL FIELD

The invention relates to a security barrier, and a method for operation thereof.

BACKGROUND

A security barrier or bollard may be used for resisting an unauthorised passage of a vehicle such as a car or lorry. Such barriers typically comprise a housing with a barrier member mounted to it. The housing is typically cast into concrete foundations below ground level. The bather member is arranged to be retractable so that it can be stowed within the housing to allow the vehicle to pass, or deployed to a working position above ground level to prevent or inhibit the vehicle to pass. In the deployed position the barrier member is required to be sufficiently high above ground level to prevent or inhibit the vehicle from passing.

Security bathers are typically provided in two categories. The first category is a high security barrier, or anti-terrorist barrier, that is intended to prevent a vehicle from passing. Such a barrier is robustly constructed and is typically about 1-1.5 meters above ground level. A high security barrier might be used at a road entrance to an airport or an official building, such as a Government building, and is typically able to withstand a crash impact from a car or lorry. The second category of security barrier might be used at a home or work premises to safeguard a car parking space or driveway from being used by another vehicle. Such barriers are relatively less robustly constructed, and may extend up to one meter above ground level.

It is known to provide a security barrier which comprises a wedge-shaped barrier member which is arranged to pivot substantially at ground level about the thin end of the wedge. The barrier member is typically the width of a road and is operable to be stowed in a housing in the ground so that a surface of the wedge is level with the ground. The security member may be deployed above ground so that an uppermost part of the wedge is up to a height of 1.5 meters. Such a security barrier has the problem that when the wedge is stowed in the ground, a deep foundation is required to be used for the housing. It will be appreciated that the depth of the foundation must be at least as deep as the height that the wedge-shape barrier member protrudes from the ground when in the deployed position. Using such a deep foundation is disadvantageous, particularly in an urban environment, because it may interfere with services such as power lines, drains, or communication cables.

In another known arrangement the barrier member comprises a rectangular flat plate having a skirt or bellows. The flat plate is arranged to pivot at ground level about one edge, and the skirt extends between the other three edges of the flat plate and the ground. A problem with such an arrangement is that the flat plate forms an overhang above ground which may represent a safety hazard due to the proximity of the ground as the flat plate moves back to the stowed position.

It is also known to provide a security bollard or post which is moveable between a vertical position above ground and a vertical position below ground. Such an arrangement also has the problem of requiring a deep foundation for a housing for the post, which must be at least as deep as the height of the bollard above ground. In an alternative arrangement the post is telescopic so that the foundations for the housing are not required to be as deep, but such a telescopic post adds cost and complexity. Such security bollards or posts generally represent less of a safety hazard than the flat plate security barrier due to the closer fitment of the bollard or post relative to the ground.

It is further known to provide a security bollard or post which is pivotable below ground level. The post is mounted in a housing having a flap which must be opened before the post can be deployed. Once the post has been deployed the flap must be closed to present a flat surface at ground level for safety reasons. Such arrangements require a relatively shallow foundation for the housing, but have the disadvantage that an additional step of opening the flap is required to deploy the post and to create a flat surface after the post has been deployed. Such arrangements also add cost and complexity.

It is broadly an object of the present invention to address one or more of the above mentioned disadvantages of previously known security barriers.

SUMMARY

What is required is a way of readily permitting a security barrier to be deployed and retracted, which may reduce or minimise at least some of the above-mentioned problems.

According to a first aspect of the invention, there provided a security barrier comprising a support and a barrier member movable relative to the support between a stowed position and a deployed position, the support having an upper part for positioning substantially at ground level, wherein the barrier member is rotatably mounted relative to the support such that an axis of rotation of the barrier member is above the upper part.

Such a security barrier provides the advantage that the barrier member can be located shallowly in the ground in the stowed position relative to the height of the barrier member when it is deployed from the support. Such an advantage is provided by the axis of rotation that is above the upper part. The upper part may be the uppermost part of the support on which a vehicle can drive or a person can walk. The security barrier can be more easily installed in the ground because relatively shallow concrete foundations can be used which are less likely to interfere with services such as power lines, drains, or communication cables. Furthermore, a security barrier so arranged may provide the advantage of a relatively close fitment of the barrier member relative to the support from which the barrier member is deployed.

Preferably at least a part of the barrier member is curved or circular. In a preferred embodiment the barrier member has a shape which is a part of an annulus. Such a curved barrier member further allows it to be deployed and stowed so that the depth of the barrier member below ground is shallow relative to the height of the barrier member above ground.

Preferably the support comprises a housing. Preferably the housing has an aperture through which the barrier member is operable to be stowed and deployed. The provision of a curved barrier member permits a close fitment to the aperture which may improve the safety of operation of the security barrier, and may inhibit debris from entering a gap between the barrier member and the aperture.

The aperture may be provided near to one end of the housing. In this arrangement the barrier member is deployed near to one end of the housing, which may improve the resistance of the security barrier from being forced out of the ground in the event of crash impact from a vehicle.

Preferably the aperture is provided with at least one adjustment part for adjusting the size of the aperture. Preferably the at least one adjustment part comprises a plate which is adjustably secured to the housing. The provision of an adjustable aperture further assists with the provision of a close fitment of the barrier member in the aperture.

Preferably the upper part comprises an upper surface of the support. Preferably the upper surface is substantially at ground level, in use. This has the advantage that a vehicle can drive on the upper surface, or a person can walk on the upper surface.

Preferably the barrier member is mounted to the support with at least one wheel to provide said rotatable mounting of the bather member relative to the support. Preferably a rolling surface of the at least one wheel engages a surface of the barrier member. In this manner the barrier member may rest on the at least one wheel.

Preferably the barrier member has a first bearing surface and the support has a second bearing surface, the bearing surfaces arranged to abut each other when the barrier member is in the deployed position. Such an arrangement has the advantage of inhibiting the barrier member from being forced out of the support in the event of a crash impact from a vehicle. Such an arrangement also provides a stop so that the barrier member is fully deployed in a particular position.

Preferably at least one of the bearing surfaces comprises at least one plate connected to the support or the barrier member.

Preferably the support includes at least one attachment region for location of at least one reinforcing bar. The at least one attachment region may be a hole of the support. Preferably the security barrier further includes opposing attachment regions at either side of the support. Using at least one reinforcing bar has the advantage of improving the connection between the support and a concrete foundation in which the support may be cast. This may further assist with inhibiting the support from lifting out of the ground in the event of a crash impact from a vehicle.

Preferably at least a part of the bather member is substantially level with the upper part when the bather member is in the stowed position. This provides the advantage that a vehicle can drive on the part, and a person can walk on the part when the barrier member is in the stowed position.

The security barrier may further including a drive device operable to provide a rotatable movement of the mounting member relative to the support. Preferably the drive device comprises at least one actuator. Preferably the at least one actuator is a linear actuator having an actuator arm.

Preferably the drive device is attachable to the barrier member with a connection device. Preferably the connection device comprises a first part for releasable connection to the barrier member. Preferably the connection device comprises a second part for releasable connection to the drive device. Preferably the first and second parts are releasably connectable to each another.

In one embodiment a depth of the barrier member in the stowed position below the upper part relative to a height of the barrier member above the upper part in the deployed position has a ratio in the range 25-55%. In a preferred embodiment the depth of the barrier member in the stowed position below the upper part relative to the height of the barrier member above the upper part in the deployed position has a ratio of substantially 40%.

In one embodiment a dimension of the axis of rotation above the upper part is between 10%-95% of a dimension of the radius of curvature of the barrier member. In a preferred embodiment the dimension of the axis of rotation above the upper part is between 65%-90% of the dimension of the radius of curvature of the barrier member. In a still further embodiment the dimension of the axis of rotation above the upper part is substantially 75% of the dimension of the radius of curvature of the barrier member. Preferably the axis of rotation is substantially parallel to the ground.

Preferably the support is provided with at least one ground anchor. Preferably the at least one ground anchor comprises at least a portion of the housing. Preferably the portion is tapered away from the upper part towards a free end of the portion which is below the upper part. The at least one ground anchor may comprise a foot of the support. The provision of a ground anchor may further resist the security barrier from being forced out of the ground in the event of a crash impact from a vehicle.

According to a second aspect of the invention there is provided a method of operating a security barrier comprising a support and a barrier member, the support having an upper part for positioning substantially at ground level, the method including:

providing a rotatable mounting between the barrier member and the support, the barrier member being rotatable relative to the support about an axis of rotation which is above the upper part; and operating the barrier member between a stowed position and a deployed position.

Such a method of operating a security barrier provides the advantage that the barrier member can be located shallowly in the ground in the stowed position relative to the height of the barrier member when it is deployed from the support. Such an advantage is provided by the axis of rotation that is above the upper part. The upper part may be uppermost of the support on which a vehicle can drive or a person can walk. The security barrier can be more easily installed in the ground because relatively shallow concrete foundations can be used which are less likely to interfere with services such as power lines, drains, or communication cables.

According to an alternative characterisation of the invention there is provided a security barrier comprising a support and a barrier member movable relative to the support between a stowed position and a deployed position, wherein the barrier member is pivotably mounted relative to the support such that a pivot axis of the barrier member is above the support.

According to another alternative characterisation of the invention there is provided a security barrier comprising a support and a barrier member movable relative to the support between a stowed position and a deployed position, wherein the security barrier has a mechanism operable to permit the barrier member to be moved horizontally and vertically relative to the support as it is moved between the stowed position and a deployed position.

According to another alternative characterisation of the invention there is provided a security barrier comprising a support and a barrier member, the support having an upper part for positioning substantially at ground level, the barrier member movable relative to the support between a stowed position where at least a part of the barrier member is below the upper part and a deployed position where at least a part of the barrier member is above the upper part, wherein the barrier member is rotatably mounted relative to the support such that an axis of rotation of the barrier member is above the upper part.

According to another alternative characterisation of the invention there is provided a security barrier comprising a support and a barrier member movable relative to the support between a stowed position and a deployed position, the support having an upper part for positioning substantially at ground level, wherein the barrier member comprises a pendulum such that an axis of pivoting of the barrier member is above the upper part.

According to another alternative characterisation of the invention there is provided a security barrier comprising a support and a barrier member movable relative to the support between a stowed position and a deployed position, wherein the barrier member comprises a pendulum requiring an increasing force to move it from the stowed position.

BRIEF DESCRIPTION OF THE DRAWINGS

Other features of the invention will be apparent from the following description of preferred embodiments shown by way of example only with reference to the accompanying drawings, in which.

DETAILED DESCRIPTION

Figure 1:
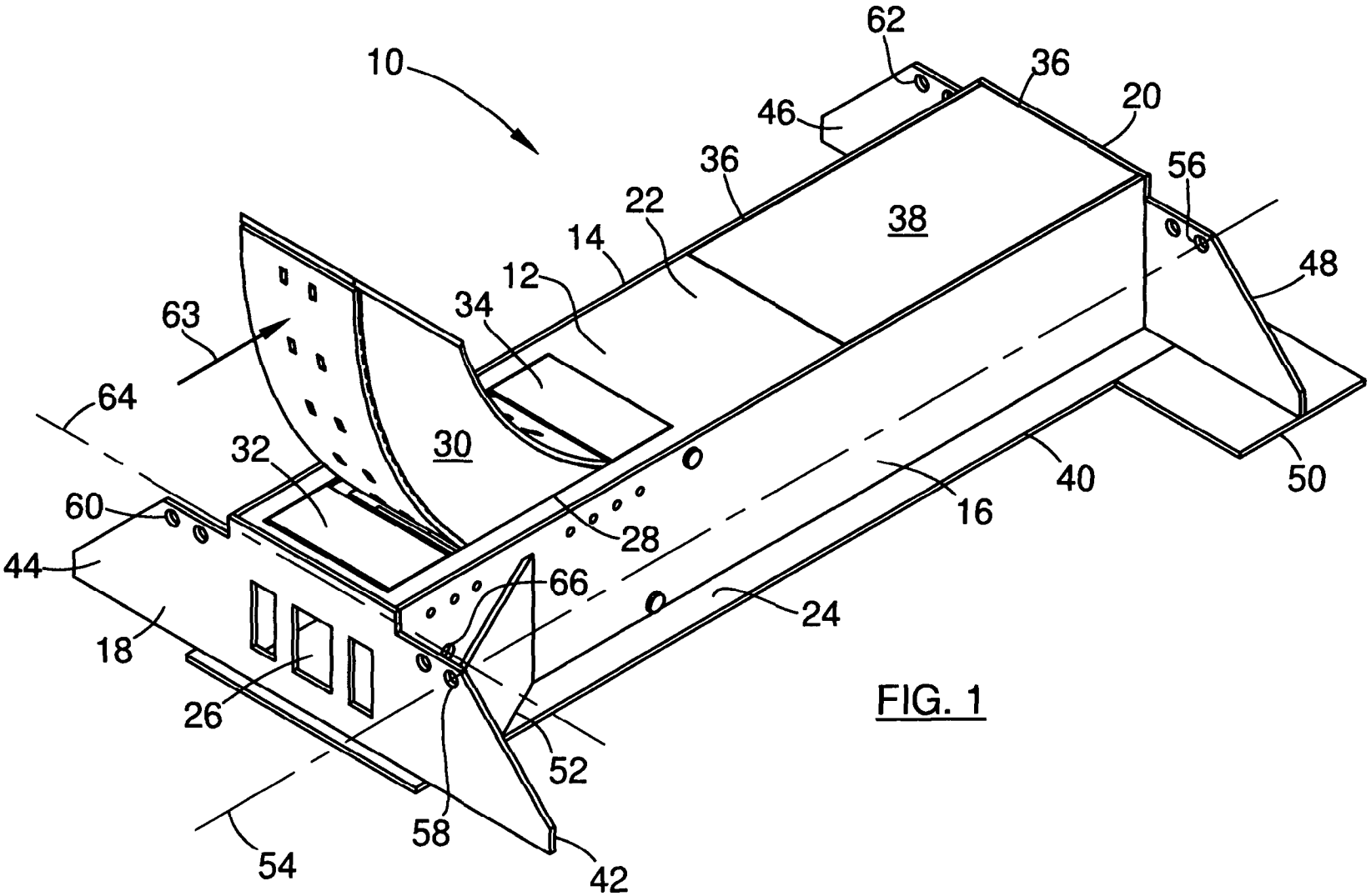
FIG. 1 shows a perspective view of a security barrier in a deployed position according to an embodiment of the invention.

FIG. 1 shows a perspective view of a security barrier in a deployed position according to an embodiment of the invention, generally designated 10. The security barrier 10 has a body 12 that is substantially cuboid in shape, and may alternatively be termed a housing. The body 12 has four vertically arranged steel plates which comprise two elongate side plates 14, 16 and two shorter end plates 18, 20. The body 12 also has a top plate 22 and a bottom plate 24 both made of steel. The plates 14, 16, 18, 20, 22, 24 are 15 mm thick and are welded together to form the body 12 which is substantially a box defining an inner space 26.

The top plate 22 has a first aperture 28 at a forward part of it through which a barrier member 30 is shown to be deployed. There is a gap of about 5 mm to 10 mm between the barrier member 30 and the top plate 22. The barrier member 30 is curved and is shown to emerge from the inner space 26 through the first aperture 28. The barrier member 30 may alternatively be termed a bollard. The first aperture 28 has a front closure plate 32 and rear closure plate 34 which are provided at the same level as the top plate 22. The front and rear closure plates 32, 34 are movable to provide a close fitment of the barrier member 30 at a front and back region of the first aperture 28. The top plate 22 has a second aperture 36 at a rearward part of it. The second aperture 36 has a back closure plate 38 which is provided at the same level as the top plate 22. The back closure plate 38 is removable for maintenance and adjustment of a drive mechanism 78 and rollers 88, 90, 92 shown in FIG. 2. The barrier member 30 is also removable from the body 12 via the second aperture 36 if it is required to be replaced.

In FIG. 1, when the security barrier 10 is in use, the body 12 is cast into a concrete foundation (not shown) in the ground to that the top plate 22 is substantially level with the ground. It will be appreciated that the body 12 provides for a self contained security barrier 10 which is relatively easy to install in situ in a concrete foundation. The bottom plate 24 has a larger footprint than the footprint defined by the four vertically arranged plates 14, 16, 18, 20. This arrangement provides a lip 40 at a base of the body 12 that provides a more secure location in the concrete foundation when it has set. Also shown is the arrangement of the elongate side plates 14, 16 relative to the shorter end plates 18, 20 whereby the end plates 18, 20 extend horizontally beyond the box defined by the four vertically arranged plates 14, 16, 18, 20 to define four horizontal anchors 42, 44, 46, 48. Each anchor tapers towards a free end which is substantially level with the bottom plate 24. Each anchor 42, 44, 46, 48 may also have a foot 50 which is a horizontal plate welded to the bottom of each anchor 42, 44, 46, 48. These arrangements further provide a more secure location in the concrete foundation when it has set. A respective gusset plate 52 may also be welded between each anchor 42, 44, 46, 48 and the side plates 14, 16. The gusset plate 52 is vertically arranged and provides additional strength to the body 12 and the anchors 42, 44, 46, 48.

Also shown is a longitudinal line 54 which represents the position of a reinforcing bar (not shown), also known as a rebar, through holes 56, 58 in the opposing anchors 42, 48. The reinforcing bar is a steel bar having a diameter of 32 mm that is commonly used for reinforced concrete foundations. It will be appreciated that the other pair of opposing anchors 44, 46 also have holes 60, 62 for another reinforcing bar. Additional holes may be provided adjacent to the holes 56, 58, 60, 62 to allow for another reinforcing bar parallel to the longitudinal line 54 if required. A transverse line 64 is also shown which represents the position of another reinforcing bar (not shown), through holes in the opposing side plates 14, 16 of the body 12. It will be appreciated that only one of these holes 66 is shown. Additional holes 67, 69, shown in FIG. 3, may also be provided for location of another reinforcing bar which is parallel to the transverse line 64. The reinforcing bar position represented by the transverse line 64 is at a forward region of the security barrier 10 near to where the barrier member 30 protrudes from the body 12. As shown in FIG. 1, the reinforcing bar extends beyond the body 12 and further assists with securing the body 12 to the concrete foundations when set. This may particularly be the case in the event of an impact from a vehicle in the direction indicated by an arrow 63, where the impact may tend to urge the front part of the body in an upwards direction.

Figure 2:
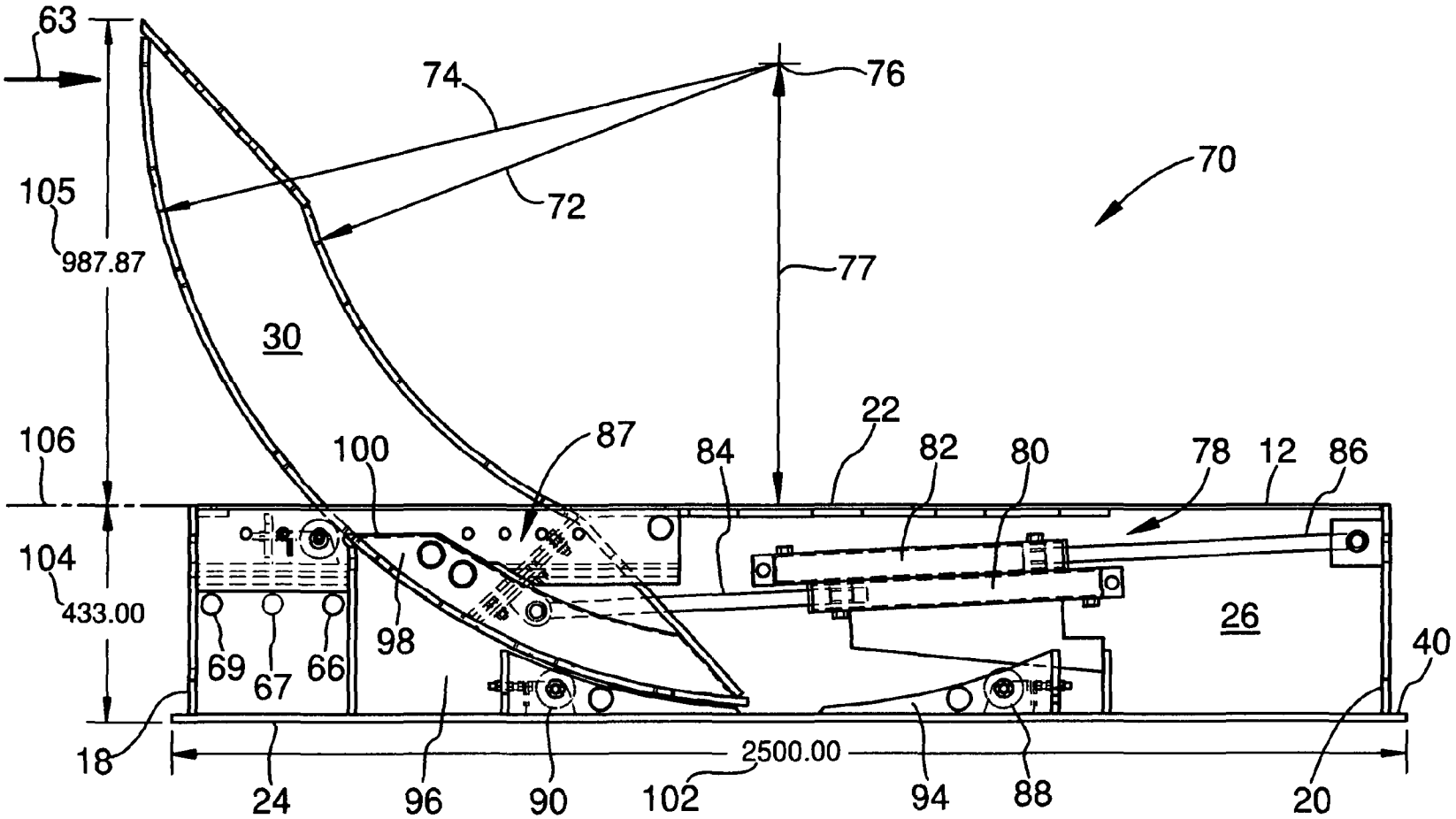
FIG. 2 shows a side view of the security barrier of FIG. 1 in a deployed position.

FIG. 2 shows a side view of the security barrier 30 of FIG. 1 in a deployed position, generally designated 70. In FIG. 2 like features to the arrangements of FIG. 1 are shown with like reference numerals. In FIG. 2 the barrier member 30 is shown to be a portion of an annulus having an inner radius 72 of 992 mm and an outer radius 74 of 1292 mm. The annulus has an axis of rotation 76 which is at a distance 77 which is about 920 mm above the top plate 22. It will be appreciated that the barrier member 30 may have any suitable shape such as an arc of a circle. Also shown is the drive mechanism 78 to move the barrier member 30 in and out of the body 12. Once the barrier member 30 is in the deployed position a locking device, such as a pin, may be used to secure it in position. The drive mechanism 78 comprises two hydraulic actuators 80, 82 having respective actuator arms 84, 86. The actuators 80, 82 are secured to each other so that the respective actuator arms 84, 86 move in opposing directions when the actuators are used to move the barrier member 30. One actuator arm 84 is connected to the barrier member 30, and the other actuator arm 86 is connected to the body 12. Both arms 84, 86 are shown in the extended position. Also shown is a connection device 87 to connect the actuator arm 84 to the barrier member 30, which will be described in greater detail with reference to FIGS. 5, 6, 8 and 9.

In FIG. 2 an outer surface of the barrier member 30 sits on three sets of rollers 88, 90, 92 which are mounted to the body 12. In this manner the rollers 88, 90, 92 carry the weight of the bather member 30. It will also be appreciated that the rollers 88, 90, 92 may be gear wheels having teeth, and the surface of the bather member 30 may have tracks shaped to correspond with the teeth. Such an arrangement may provide an advantageous way of rotating the sub-frame and providing grip between the gear wheels and the tracks. Alternatively, the rollers 88, 90, 92 may be termed wheels. Also shown are two arcuate guides 94, 96 which are welded to the bottom plate 24 and conform to the shape of the barrier member 30.

It will be appreciated that any suitable drive mechanism 78 could be used that provides the required movement of the barrier member 30 relative to the body 12. Suitable drive mechanisms may include a rack and pinion gear arrangement whereby the rack is mounted on the barrier member 30 and the pinion is one of the rollers 88, 90, 92.

In FIG. 2 the barrier member 30 is shown to be fully deployed so that the shoulders 98 on either side of the barrier member 30 abut bearing surfaces 100 on the inside of the side plates 14, 16. It will be appreciated that the parts of each shoulder 98 that contact the inside of the side plates 14, 16 are also bearing surfaces. The bearing surfaces 100 of the side plates 14, 16 and the shoulders 98 are substantially horizontal when they abut each other. Such an arrangement stops the barrier member 30 from rotating fully out of the body, particularly in the event of an impact from a vehicle in the direction indicated by the arrow 63. The shoulders 98 are described in greater detail with reference to FIGS. 5-7. In FIG. 2 the body 12 is shown to be about 2500 mm long at 102, and 430 mm high at 104. Using the dimensions 72, 74, 102, 104 the barrier member 30 is shown to be able to be deployed to a height of about 980 mm above a ground level 106. It will be understood that the ground level 106 is, for example, level with a road.

Figure 3:
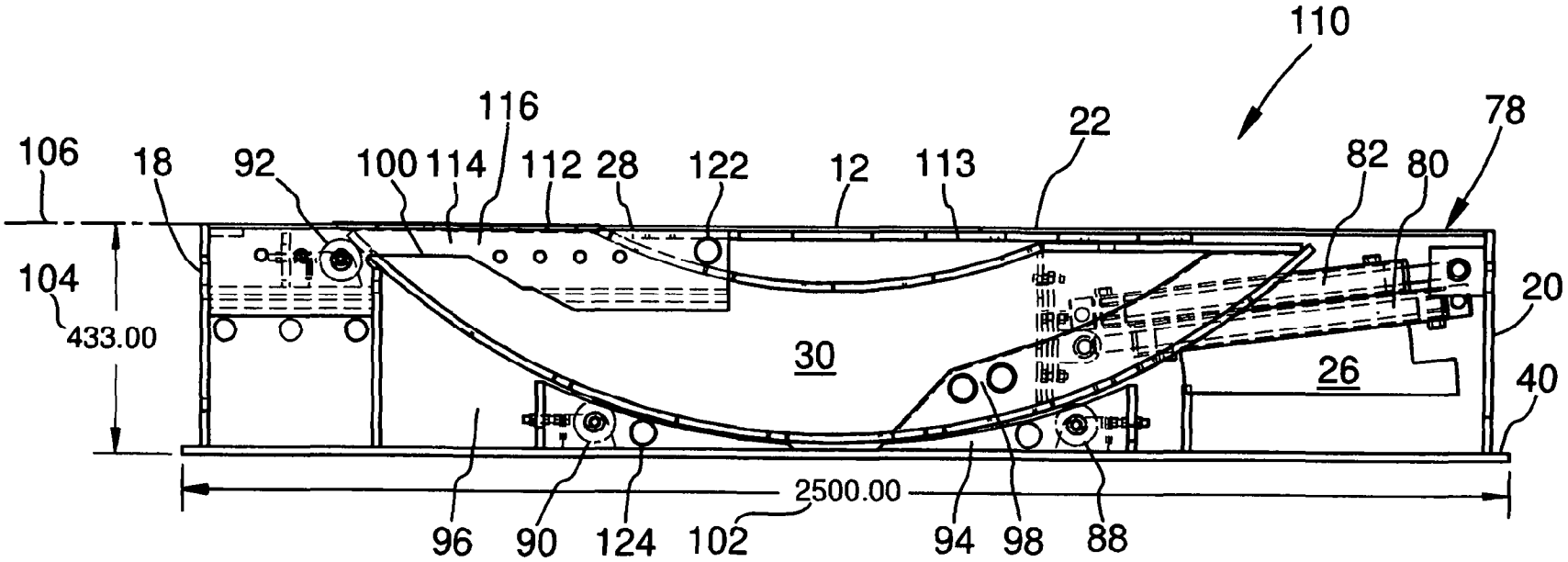
FIG. 3 shows a side view of the security barrier of FIGS. 1 and 2 in a stowed position.

FIG. 3 shows a side view of the security barrier of FIGS. 1 and 2 in a stowed position, generally designated 110. In FIG. 3 like features to the arrangements of FIGS. 1 and 2 are shown with like reference numerals. In FIG. 3 the actuators 80, 82 are shown in the retracted position which operates the barrier member 30 so that it moves on the rollers 88, 90, 92 into the stowed position. The first aperture 28 is shown to be close fitting around the barrier member 30, and the gap of about 5 mm to 10 mm between the barrier member 30 and the top plate 22 remains substantially constant as the barrier member 30 moves between the deployed position shown at 70, and the stowed position shown at 110. In the stowed position an upper part 112 of the barrier member 30 is level with the top plate 22 so that a vehicle can drive on it, or a person can walk on it. Load imparted on upper part 112 may be transferred to an underside 113 of to the top plate 22. Also shown in FIG. 3 are the bearing surfaces 100 each of which are comprised of three plates 114 bolted to the inside of each side plate 14, 16 as shown at 116. The three plates 114 for a laminated structure. Such a laminated structure may provide an improved crash performance in the event of an impact from a vehicle. Such a laminated structure may be easier to manufacture than a similar structure made from one piece of steel.

Referring to FIGS. 1-3 it will be appreciated that together the rollers 88, 90, 92, arcuate guides 94, 96, and the action of the drive mechanism 78 acting on the body 12 and the barrier member 30 operate to move the barrier member 30 in and out of the inner space 26. The provision of the axis of rotation 76 above the top plate 22 permits the barrier member 30 to be deployed to a relatively high level and to be stowed so that the body 12 is not too deep relative to a ground level 104. In the embodiments shown the barrier member 30 is deployed to a height of about 988 mm above ground level 106, and the body has a depth of 433 mm below ground level 106. The axis of rotation 76 should be above the top plate 22 at a distance shown at 77 to allow the barrier member 30 to be deployed above ground level 106 and to be stowed below ground level 106 so that the depth of the body 12 shown at 104 is not significantly larger than a depth of the barrier member 30 shown at 142 in FIG. 5.

It will be further appreciated that to obtain at least a part of the benefit of the embodiments of the invention the distance 77 could be between 10%-95% of the radius 72, 74 of the barrier member 30 depending on the radius of curvature of the barrier member 30. In a preferred embodiment the distance shown at 77 is 65%-90% of the radius 72, 74 of the barrier member 30. In a further preferred embodiment the distance shown at 77 is 75% of the radius 72, 74 of the barrier member 30. Such a radius of curvature may be an average radius of curvature of the barrier member 30. It will be appreciated that the axis of rotation 76 of the barrier member 30 is in a fixed position relative to the barrier member 30 and the body 12 as the barrier member 30 is operated. In the embodiments shown the dimension 77 is about 830 mm, although it will be appreciated that the dimension 77 could be between 98 mm to 938 mm to gain at least a part of the benefit of the embodiment of the invention.

It will further be appreciated that the distance of the barrier member 30 in the stowed position below the top plate 22 is about 40% of the distance 105 of the barrier member 30 above the top plate 22 in the deployed position. Such an arrangement is provided by having the axis of rotation 76 above the top plate 22 at the distance 77 described above. It will be appreciated that varying the dimensions of the security barrier 10 might lead to the distance of the barrier member 30 in the stowed position below the top plate 22 relative to the distance 105 of the barrier member 30 above the top plate 22 in the deployed position being the range 25-55%.

Figure 4:
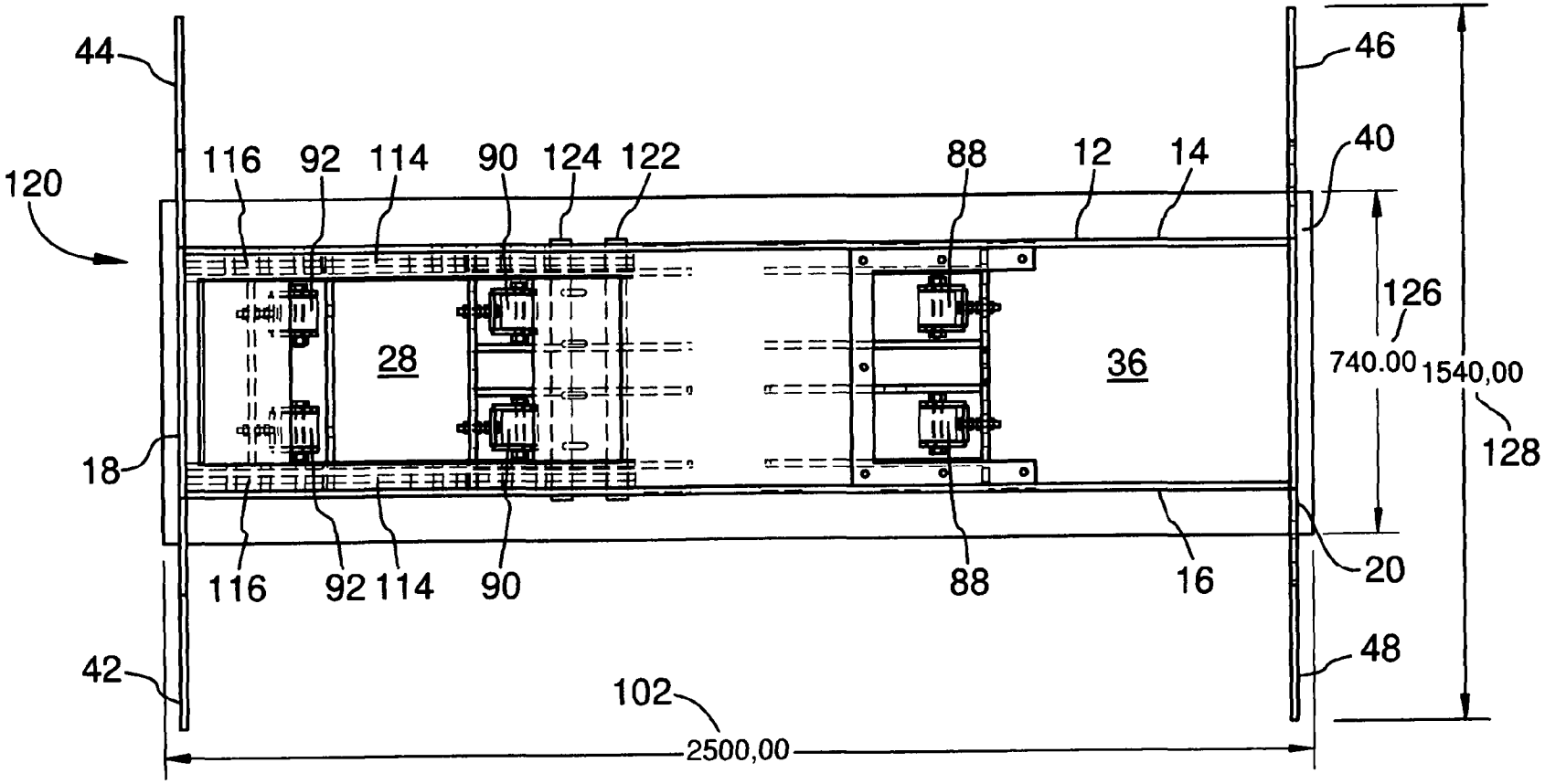
FIG. 4 shows a view from above of the body of FIGS. 1-3.

FIG. 4 shows a view from above of the body 12 of FIGS. 1-3, generally designated 120. In FIG. 4 like features to the arrangements of FIGS. 1-3 are shown with like reference numerals. In FIG. 4 the top plate 22 is removed for clarity. The three plates 114 are shown on the inside of each side plate 14, 16. The bolts 116 are also shown to hold the three plates 114 to each side plate 14, 16. The three plates 114 provide the bearing surfaces 100 for the shoulders 98, and also have the effect of locally increasing the strength of the body 12. It is preferred to use the bolts 116 and not welding because welding may create unpredictable local stresses which should be avoided for predicting how the security barrier 10 might behave in the event of a crash impact. The sets of rollers 90, 92 can be seen through the first aperture 28, and the set of rollers 88 can be seen through the second aperture 36. Also shown in FIGS. 3 and 4 are an upper pin 122 and a lower pin 124 which are welded to the side plate 14, 16 to improve the strength of the body 12, particularly in the event of a crash impact. The pins 122, 124 are made of high strength steel and have the advantage of increasing the strength of the body 12. The dimension of the width of the bottom plate 24 is shown at 126 to be about 740 mm. The dimension of the width of the end plates 18, 20 is shown at 128 to be about 1540 mm.

Figure 5:
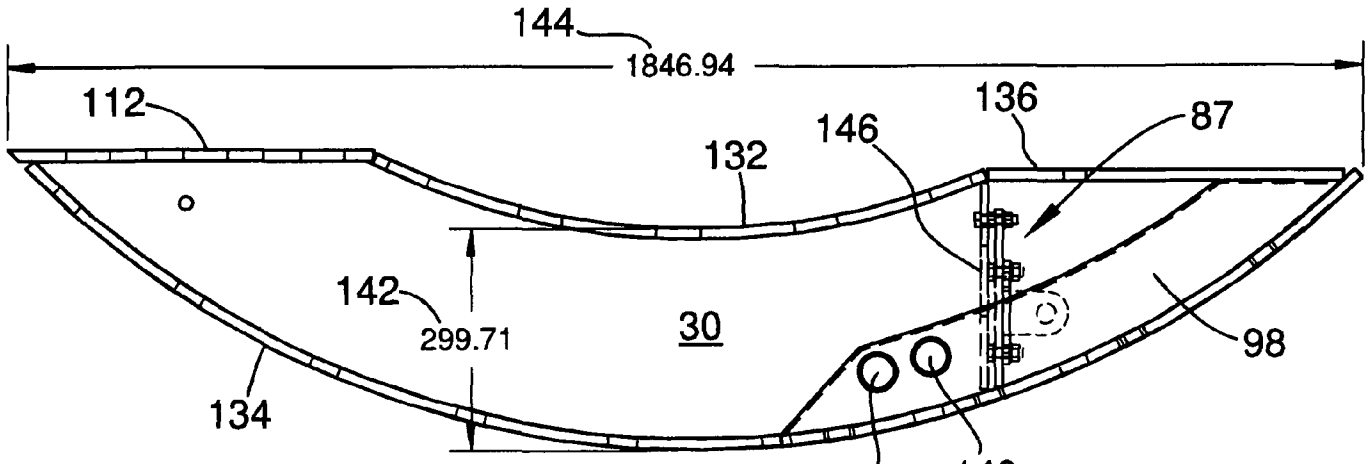
FIG. 5 shows a side view of a barrier member of FIGS. 1-3.

FIG. 5 shows a side view of the barrier member 30 of FIGS. 1-3. In FIG. 5 like features to the arrangements of FIGS. 1-3 are shown with like reference numerals. In FIG. 5 the barrier member 30 is shown to comprise a first curved plate 132 and a second curved plate 134 which form an inner radius 72 and an outer radius 74 of the part annulus. Two bars 138, 140 are shown which pass through the barrier member 30 between the shoulders 98 on either side of the barrier member 30. The bars 138, 140 are made of high strength steel and are welded to the shoulders 98 to improve strength of the barrier member 30. Also shown is the upper part 112 of the barrier member 30 and the connection device 87 which is bolted to a connection member 146 of the barrier member 30. The dimension of the length of the barrier member 30 shown at 144 is about 1847 mm.

Figure 6:
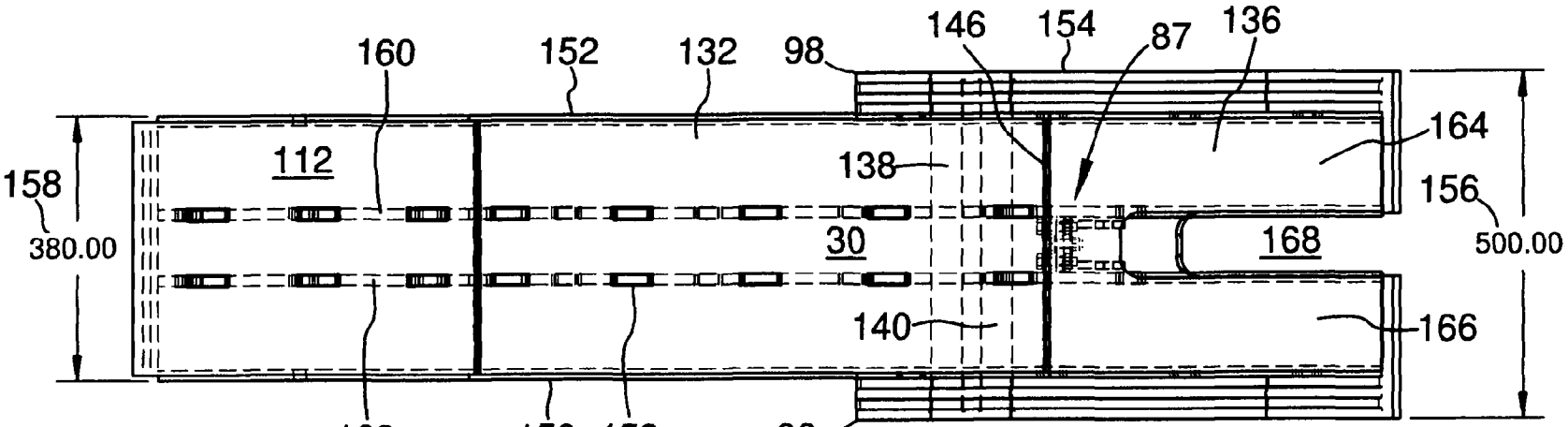
FIG. 6 shows a view from above of the barrier member of FIG. 5.

FIG. 6 shows a view from above of the barrier member 30 of FIG. 5. In FIG. 6 like features to the arrangements of FIG. 5 are shown with like reference numerals. In FIG. 6 the barrier member 30 has side plates 150, 152 which are welded to the first and second curved plates 132, 134. The shoulders 98 on either side and at one end of the barrier member 30 are also shown and they each comprise four plates 154 which are welded together. The four plates 154 form a laminated structure. Such a laminated structure may provide an improved crash performance in the event of an impact from a vehicle. Such a laminated structure may be easier to manufacture than a similar structure made from one piece of steel. Also shown are the two bars 138, 140 which pass between the shoulders 98 on either side of the barrier member 30. The barrier member 30 is shown to have a width at an end with the shoulders 98 of about 500 mm at 156. The barrier member 30 is shown to have a width at an end without the shoulders 98 of about 380 mm at 158.

The barrier member 30 has two internal plates 160, 162 which run along the length of the barrier member 30. The internal plates 160, 162 are welded to the first and second curved plates 132, 134 as shown at 153. At the end of the barrier member 30 having the shoulders 98 the barrier member 30 has two fingers 164, 166 which define a space 168 between them. The space 168 is for location of the actuator arm 84 so that it can be attached to the connection device 87. The internal plates 160, 162 also form the fingers 164, 166 and define the space 168.

Figure 7:
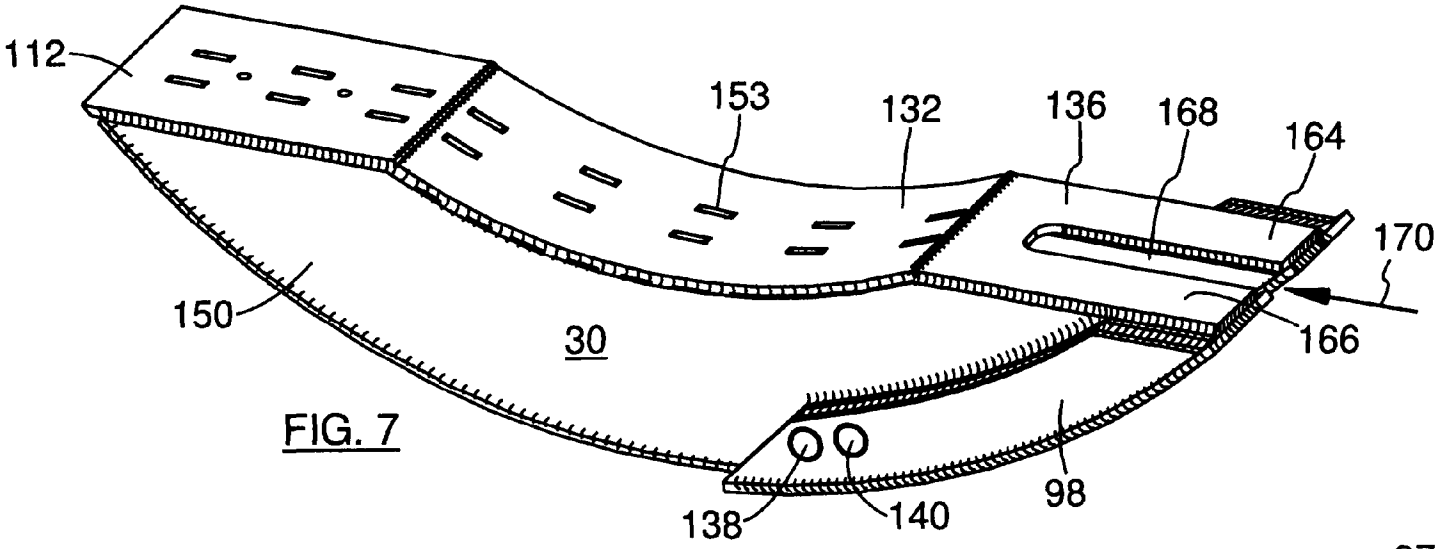
FIG. 7 shows a perspective view of the barrier member of FIGS. 5 and 6.

FIG. 7 shows a perspective view of the barrier member of FIGS. 5 and 6. In FIG. 7 like features to the arrangements of FIG. 6 are shown with like reference numerals. In FIG. 7 the welds 153 between the internal plates 160, 162 and the first curved plate 132 can be seen. The welds between the bars 138, 140 and the shoulder 98 can also be seen.

Figure 8:
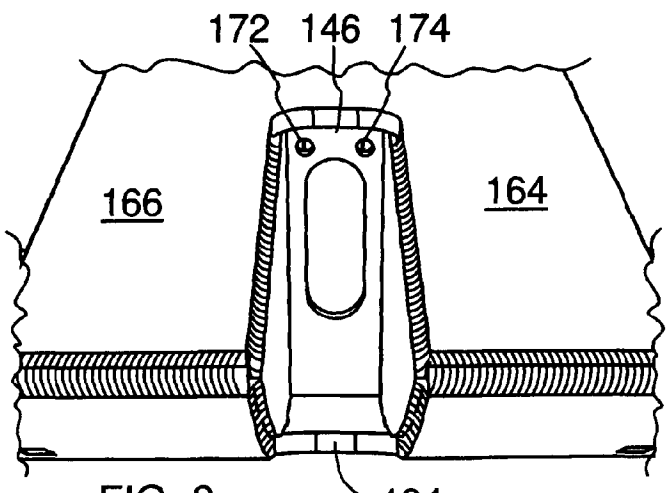
FIG. 8 shows an end view of the barrier member shown in FIG. 7.

FIG. 8 shows an end view of the barrier member 30 shown in FIG. 7. In FIG. 8 like features to the arrangements of FIG. 7 are shown with like reference numerals. In FIG. 8 the end view is from the direction indicated by arrow 170 in FIG. 7. In FIG. 8 the connection member 146 is shown at one end of the space 168 between the fingers 164, 166. The connection member 146 is shown to have two holes 172, 174 for attachment of the connection device 87.

Figure 9:
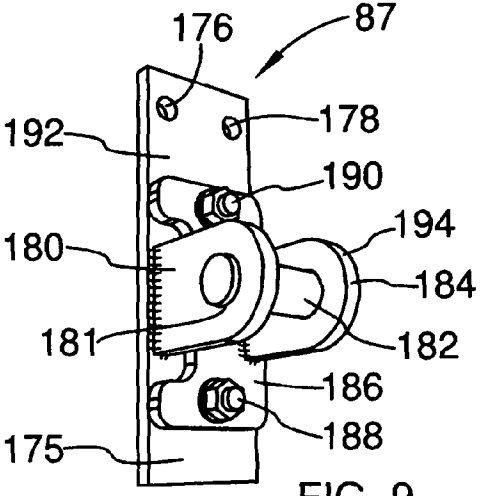
FIG. 9 shows a perspective view of a connection device according to an embodiment of the invention.

FIG. 9 shows a perspective view of the connection device 87 according to an embodiment of the invention. The connection device 87 has a first connection plate 175 with two holes 176, 178 corresponding to the two holes 172, 174 of the connection member 146. The first connection plate 174 has a first support plate 180 welded so that it is perpendicular to it. The first support plate 180 has a hole 181 in it through which a pin 182 of a second support plate 184 can be slidably located. The second support plate 184 is welded to a second connection plate 186 so that it is perpendicular to it. The first connection plate 174 and the first support plate 180 form a first part 192 of the connection device 87. The second connection plate 186, second support plate 184 and the pin 182 form a second part 194 of the connection device 87.

In use, the actuator arm 84 has an eye which is located over the pin 182 of the second part 194. The pin 182 is then slidably engaged in the hole 181 of first support plate 180. The first and second connection plates 174, 186 of the first and second parts 192, 194 are then bolted together at 188 and 190. It will be appreciated that the first and second connection plates 174, 186 lie on top of each other. The connection device 87 is then located into the space 168 between the fingers 166, 168 so that the two holes 176, 178 of the first connection plate 174 align with the two holes 172, 174 of the connection member 146. The first connection plate 174 is then bolted to the connection member 146. Such an arrangement is advantageous because it allows the actuator arm 84 to be attached to the connection device 87 prior to locating it in the space 168 between the fingers 164, 166 which is small space. The connection device 87 simplifies the process of attaching the actuator arm 84 to the barrier member 30.

Figure 10:
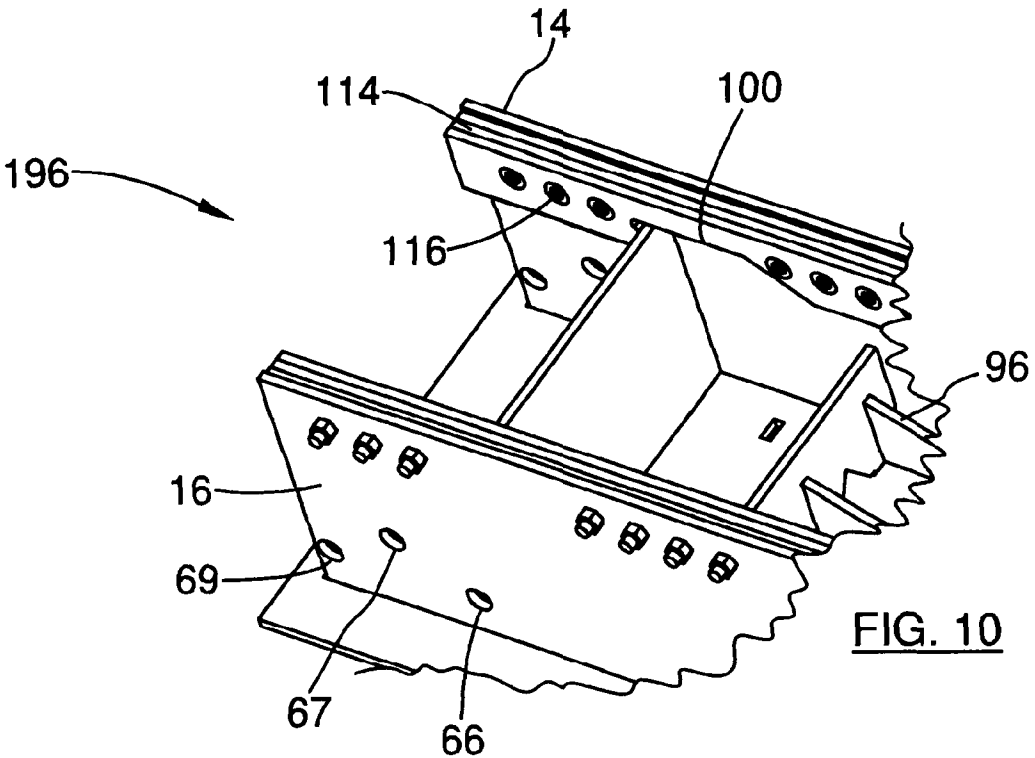
FIG. 10 shows a perspective view of a body shown in FIGS. 1-4.

FIG. 10 shows a perspective view of the body 12 shown in FIGS. 1-4, generally designated 196. In FIG. 10 like features to the arrangements of FIGS. 1-4 are shown with like reference numerals. In FIG. 10 the body 12 is shown prior to welding the end plate 18 and the top plate 22 in place for illustrative purposes. The arrangement of the three plates 114 bolted together at 116 on the inside of each side plate 14, 16 are shown. The three plates 114 comprise the bearing surfaces 100. It can also be seen that the bolts 116 are Allen screws which are countersunk on the inside of the body 12 and bolted on the outside of the body 12. Also shown are the locations of holes 66, 67, 69 for the reinforcing bar, and the arcuate guide 96 for the barrier member 30.

Figure 11:
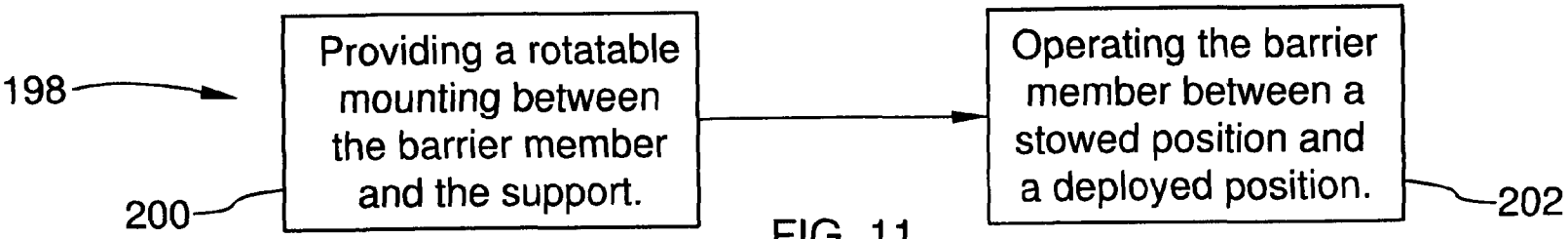
FIG. 11 shows a diagram of a method according to an embodiment of the invention.

FIG. 11 shows a diagram of a method according to an embodiment of the invention, generally designated 198. The method 198 is method of operating a security barrier 10 comprising a body 12, or support, and a bather member 30, the body 12 having an upper surface 22 for positioning substantially at ground level 106. The method includes providing a rotatable mounting between the barrier member 30 and the body 12, as shown at 200. The barrier member 30 being rotatable relative to the body 12 about an axis of rotation 76 which is above the upper surface 22. The method including operating the barrier member 30 between a stowed position 110 and a deployed position 70, as shown at 202.

Whereas the barrier member 30 described above is about 380 mm in width, it is also envisaged that the bather member 30 might be substantially the width of a road, for example up to about 6 meters. In such an arrangement the body 12 may be required to be slightly wider than the barrier member 30 to accommodate it in the stowed position. Additional or more powerful actuators 82, 80 may also be required to operate the barrier member 30.

The barrier member 30 described above with reference to FIG. 1-11 is shown to be part of an annulus, but it will be appreciated that any suitable shaped barrier member 30 may be used. In one embodiment the barrier member 30 is a curved plate.

In the above embodiments the security barrier 10 described is intended to be crash proof so that a car or lorry travelling at speed is substantially prevented from passing the barrier member 30. As such the security barrier 10 is relatively large and constructed of relatively heavy weight material. Such a security barrier 10 might alternatively be termed a high security barrier, a vehicle barricade, a truck stopper or a road blocker and might be particularly useful to guard against terrorist activities. It is also envisaged that a smaller version of the above described embodiments could be used for application at the home or business premises. Such a less heavy duty security barrier 10 may not require a drive mechanism and may be operated by hand. The less heavy duty security barrier 10 may be used to guard a parking space or driveway. The high security barrier 10 and the smaller version security barrier 10 may alternatively be termed a vehicle security barrier 10.

It will be understood that the barrier member 30 described above is arranged to be rotatably mounted relative to the body 12 so that it partially rotates. An alternative way of describing this arrangement is that the barrier member 30 is mounted to the body 12 so that it can pivot between the stowed position 110 and the deployed position 70 where the axis of pivoting 76 is above the top plate 22. It will be appreciated that the axes of pivoting 76 or the axis of rotating 76 is substantially parallel to the ground. This is in contrast to the prior art wedge-shaped or rectangular flat plate type security barriers which are pivotably connected at ground level to a support. With the present embodiments of the invention the barrier member 30 and the body 12 are connected to each other by the rollers 88, 90, 92 which act on a periphery of the barrier member 30 to provide the pivotable movement, or rotational movement of the barrier member 30 relative to the support. This is in contrast to the wedge-shaped or rectangular flat plate type security barriers of the prior art which are connected to a support located in the ground by a pivotable connection located at a thin end of the wedge or at one edge of the flat plate. With the above described embodiments it will also be appreciated that the bather member 30 is movable relative to the body 12 between a stowed position where at least a part of the barrier member 30 is below an upper part of the body 12, and a deployed position where at least a part of the barrier member 30 is above the upper part. The upper part may be the top plate 22 which is at ground level and which is a surface on which a vehicle can drive or a person can walk.

According to another way of describing the above embodiments the security barrier 30 may be considered to be a pendulum in that it has a pendulum mounting that permits the security barrier 30 to be moved between the stowed position 110 and the deployed position 70. The pendulum mounting is provided by the rollers 88, 90, 92 acting on the barrier member 30. As such the barrier member 30 and the body 12 to which the barrier member 30 is mounted may be considered to be a pendulum arrangement. In this pendulum arrangement the axis of rotation 76, which is above the top plate 22, is an axis of pivoting of the barrier member 30, or pendulum. In the stowed position 110 the bather member 30 is substantially at rest or substantially in the equilibrium position of the pendulum arrangement under the action of gravity. It will be appreciated that the force required to move the pendulum-like barrier member 30 away from the stowed position, or equilibrium position, increases as the barrier member 30 is moved towards the deployed position. This is due to the mass of the barrier member 30 which is distributed along the length of the barrier member 30. Such a requirement for an increasing force is in contrast to the prior art arrangements which typically require a constant force, or a decreasing force to deploy a barrier member to the deployed position. With the above embodiments, the mass of the barrier member 30 stays constant, but the weight of the barrier member 30 increases as it is moved away from the stowed position. This is due to the fact that the barrier member 30 is moved away from the equilibrium position.

The invention claimed is:

1. A security barrier having a support and a barrier member movable relative to the support between a stowed position and a deployed position, the support having an uppermost part for positioning substantially at ground level, the barrier member being pivotally mounted relative to the support such that a pivot axis of the barrier member is above the uppermost part, wherein the pivot axis is a fixed axis through the entire movement of the barrier member between the stowed position and the deployed position, such that the barrier member only follows the path of a circle between the stowed position and the deployed position.

2. A security barrier according to claim 1, wherein the support comprises a housing.

3. A security barrier according to claim 2, wherein the housing has an aperture through which the barrier member is operable to be stowed and deployed.

4. A security barrier according to claim 3, wherein the aperture is provided near to one end of the housing.

5. A security barrier according to claim 3, wherein the aperture is provided with at least one adjustment part for adjusting the size of the aperture.

6. A security barrier according to claim 5, wherein the at least one adjustment part comprises a plate which is adjustably secured to the housing.

7. A security barrier according to claim 1, wherein the uppermost part comprises an upper surface of the support.

8. A security barrier according to claim 7, wherein the upper surface is substantially at ground level, in use.

9. A security barrier according to claim 1, wherein the barrier member is mounted to the support with at least one wheel to provide said pivotable movement of the barrier member relative to the support.

10. A security barrier according to claim 9, wherein a rolling surface of the at least one wheel engages a surface of the barrier member.

11. A security barrier according to claim 1, wherein the barrier member has a first bearing surface and the support has a second bearing surface, the first and second bearing surfaces arranged to abut each other when the barrier member is in the deployed position.

12. A security barrier according to claim 11, wherein at least one of the first and second bearing surfaces comprises at least one plate connected to the support or the barrier member.

13. A security barrier according to claim 1, wherein at least a part of the barrier member is substantially level with the uppermost part when the barrier member is in the stowed position.

14. A security barrier according to claim 1, and further including a drive device to provide a pivotable movement of the mounting member relative to the support.

15. A security barrier according to claim 1, wherein a dimension of the pivot axis above the uppermost part is between 10%-95% of a dimension of a radius of curvature of the barrier member.

16. A security barrier according to claim 15, wherein the dimension of the pivot axis above the uppermost part is between 65%-90% of the dimension of the radius of curvature of the barrier member.

17. A security barrier according to claim 16, wherein the dimension of the pivot axis above the upper part is substantially 75% of the dimension of the radius of curvature of the barrier member.

18. A method of operating a security barrier according to claim 1, the method comprising operating the barrier member between a stowed position and a deployed position.

19. A security barrier according to claim 3, wherein a gap between the barrier member and the top plate within the aperture remains constant as the barrier member moves between the deployed position and the stowed position.

20. A security barrier comprising:

a support having an uppermost part for positioning substantially at ground level; and a barrier movable relative to the support between a stowed position and a deployed position, the barrier having first and second ends, wherein the barrier moves about a fixed pivot axis defined by a constant radius of curvature from the barrier to the fixed pivot axis, the fixed pivot axis being located at a point above the uppermost part, and wherein the barrier member has a curved shape with a radius of curvature that is constant from the first to the second end.

21. A security barrier having a support and a barrier member movable relative to the support between a stowed position and a deployed position, the support having an uppermost part for positioning substantially at ground level, the barrier member being pivotally mounted relative to the support such that a pivot axis of the barrier member is above the uppermost part, wherein the pivot axis is a fixed axis, and the barrier member has a curved shape that is the same curvature from one end of the barrier member to an opposite end of the barrier member, the curved shape being a segment of an annulus and the entire barrier member following only a path of a circle between the stowed position and the deployed position.

22. A security barrier having a support and a barrier member movable relative to the support between a stowed position and a deployed position, the support having an uppermost part for positioning substantially at ground level, the barrier member being mounted relative to the support such that the barrier member is substantially above the uppermost part in the deployed position, wherein the entire barrier member moves along a curved path that is constant as the barrier member moves between the stowed position and the deployed position, the curved path having a constant radius relative to a fixed axis above the uppermost part of the support, and wherein the barrier member has a body with a first end and a second end opposite the first end, the body having a rectangular cross-section and a curved shape between the first and second ends, the curved shaped having a constant radius from the first end to the second end.

23. A security barrier comprising:

a support having an uppermost part for positioning substantially at ground level; and a barrier movable relative to the support between a stowed position and a deployed position, the barrier having first and second ends, wherein the barrier moves between the stowed and deployed positions only about a fixed pivot axis defined by a constant radius of curvature from the barrier to the fixed pivot axis, the fixed pivot axis being located at a point above the uppermost part, and wherein the barrier member has a body that is substantially rectangular in cross-section and that is a segment of an annulus shape between the first and second ends, the segment being less than half a circumference of the annulus shape.

* * * * *